United States Patent [19]

O'Brian et al.

[11] 4,166,343

[45] Sep. 4, 1979

[54] COLLAPSIBLE STRUCTURES

[76] Inventors: Edward D. O'Brian, 910 Iroquois St., Anaheim, Calif. 92801; William M. Plachy, 3533 Encinitas Rd., San Marcos, Calif. 92069

[21] Appl. No.: 755,997

[22] Filed: Jan. 26, 1977

[51] Int. Cl.[2] ..... E04B 1/344

[52] U.S. Cl. ..... 52/66; 52/69; 296/173

[58] Field of Search ..... 52/66, 69, 70, 71; 296/23 G; 220/6, 7; 217/15

[56] References Cited

U.S. PATENT DOCUMENTS

| | | | |
|---|---|---|---|
| 1,091,391 | 3/1914 | Romans | 217/15 |
| 1,101,019 | 6/1914 | Funkelstein | 217/15 |
| 1,917,824 | 7/1933 | Burns | 52/71 |
| 2,963,122 | 12/1960 | Tagemann | 52/66 |
| 3,050,331 | 8/1962 | Mansen | 52/66 |
| 3,583,755 | 6/1971 | Hedricks | 52/66 |
| 3,632,153 | 1/1972 | Knudsen | 52/66 |
| 3,766,844 | 10/1973 | Donnelly | 52/66 |

FOREIGN PATENT DOCUMENTS

| | | | |
|---|---|---|---|
| 1296563 | 5/1969 | Fed. Rep. of Germany | 220/7 |
| 766409 | 1/1957 | United Kingdom | 217/15 |

*Primary Examiner*—Price C. Faw, Jr.

*Assistant Examiner*—Henry Raduazo

*Attorney, Agent, or Firm*—Edward D. O'Brian

[57] ABSTRACT

Hollow, generally rectilinear structures having a top, a bottom, sides and ends can be constructed so as to be capable of being manipulated between a "normal" or unfolded type configuration and a collapsed or folded configuration in which the ends extend generally parallel to and beneath the top and in which the sides are folded so as to be located next to the ends generally between the bottom and the top. Such a structure includes hinges connecting the ends to the top so that they can be pivoted so as to lie generally parallel to the top. Such a structure also includes a frame or frame-type elements forming a part of the top and extending adjacent to the ends when the ends are folded into such a collapsed position. The sides consist of an even number of elongated panels located in edge relationship and joined by hinges to the frame or frame elements of the top, to the bottom and to each other in such a manner that they may be folded inwardly so as to be located generally parallel to the top and the bottom next to the ends when the ends are in the folded position indicated. Such a structure is disclosed as having utility as a playhouse or storage shed but can be utilized for other purposes such as a container.

7 Claims, 9 Drawing Figures

COLLAPSIBLE STRUCTURES

BACKGROUND OF THE INVENTION

The invention set forth in this specification pertains to new and improved collapsible structures, each of which is capable of being manipulated between a collapsed or folded configuration in which all of its parts fit closely adjacent to one another and a normal or unfolded configuration or position in which the parts form a hollow, generally rectilinear structure having a top, a bottom, and parallel sides and parallel ends. The structures of this invention are presently considered to have their primary utility when used as children's playhouses or as storage sheds. However, it is also considered that such structures are capable of being utilized for a wide variety of other diverse purposes such as, for example, as in large containers for use in shipping various types of goods.

The field of collapsible structures of the general type to which the invention pertains is considered to be an old, worked-over field. Many individuals have recognized the utility of collapsible structures capable of being manipulated so as to have a configuration in which such structures occupy a minimum volume and a configuration in which such structures are expanded so as to be capable of being used in a utilitarian manner. Collapsible structures of the type to which the invention pertains have previously been utilized as animal containers, portable buildings, containers and probably in many other fields.

The present invention is primarily the result of the recognition of the fact that there is a need for collapsible structures for use as children's playhouses which can be manipulated between folded or compacted configurations and open configurations in which such playhouses are expanded so that they can be utilized for play purposes. This need in effect is related to several factors.

Normally playhouses are sufficiently large so that it is undesirable to sell such playhouses in an operative condition. When such playhouses are completely erected they take up too much volume to be conveniently shipped and stored and further they are too large for a customer to carry to an ultimate destination. As a consequence of this it has been commonplace to merchandise such playhouses in a so-called "knocked down" or K.D. condition.

When playhouses are sold in a knocked down condition various parts of such playhouses are not completely secured or assembled together in an operative manner. The degree to which such a playhouse may be assembled when sold in such a knocked down condition is normally determined by economic factors and the relative ease of assembling the unassembled parts of such a structure. From the point of view of lowering manufacturing costs and, hence, the marketing price the greater the extent that a playhouse should be unassembled as it is sold.

On the other hand, the less a playhouse is assembled the more trouble an ultimate customer will have in placing such a playhouse in an operative condition. Generally speaking those who purchase items such as playhouses and various related type structures such as storage sheds are not overly skilled in assembling without difficulty the components of such structures. Further, such individuals tend to resent being faced with what in effect is a jigsaw puzzle supposedly representing a utilitarian product.

Because of the manner in which playhouses have been constructed in the past normally such structures have been essentially permanent type structures after they have been installed in an operative or play location. In many cases this presents no problem. However, frequently a parent may desire to have a playhouse for use by children but will not have adequate space so as to accommodate a permanently erected playhouse. As an example of this an apartment occupant may desire a playhouse for use by children but because of the size of the apartment will be precluded from having such a playhouse because of the space occupied by the structure.

A recognition of these factors has led to the belief that there is a need for new and improved playhouses, each of which is of such a character that it may be manipulated between a collapsed or folded configuration in which it may be easily shipped and stored by a merchandiser and/or an ultimate user and between an unfolded "use" or expanded configuration in which the structure may be utilized for its intended purpose. This recognition has resulted in the further view that there is a related need for many other types of structures such as small storage sheds which can also be so manipulated.

SUMMARY OF THE INVENTION

An objective of the present invention is to fulfill these needs. A more specific objective of the invention is to provide new and improved collapsible structures which can easily be manipulated between collapsed or folded configurations and operative configurations without assembly or disassembly type operations. Further objectives of the present invention are to provide structures of the type indicated which are not significantly difficult to construct, which may be easily and conveniently manipulated between the two positions indicated, which possess adequate strength and other characteristics for their intended utilization and which are not significantly more expensive than various prior related structures of such a character that they are incapable of being manipulated between positions as indicated.

In accordance with this invention these objectives are achieved by providing a hollow, generally rectilinear structure having a top, a bottom, parallel, spaced, opposed sides extending between the top and the bottom and parallel, opposed ends extending between the top and the bottom in which the improvement comprises:

frame means for use in providing space into which both of said ends fit when said structure is in a folded configuration, said frame means forming a part of said top and being located generally beneath the remainder of said top, and serving to space said sides from the remainder of said top; a first hinge means connecting each of said ends with said top, each first hinge means holding the one of said ends to which it is connected so that such end can be pivoted to a position generally parallel to said top and within said frame means; each of said sides consisting of an even number of elongated panels having parallel top and bottom edges, said panels in each of said sides being located in edge to edge relationship with the lowermost of said panels being located with a bottom edge against said bottom and with the uppermost of said panels being located with a top edge against said frame means; another hinge means connecting the top edge of the uppermost of said panels of each of said sides with said frame means; a further hinge means connecting the lowermost edge of each of said panels of each of said sides with said bottom; intermediate hinge means on each of said sides connecting the adjacent side edges of said panels together; said other, said further and said intermediate hinge means oriented so as to permit both of said sides to be pivoted relative to one another and to said top and said bottom about parallel axes generally between said bottom and said frame means when said ends are positioned generally within said frame means; said ends fitting closely with respect to the interiors of said sides so as to abut against said sides to prevent folding of said panels of said sides and serving to reinforce said sides against movement relative to said top and said bottom.

BRIEF DESCRIPTION OF THE DRAWINGS

The invention is best more fully explained with reference to the accompanying drawings in which.

Figure 1:
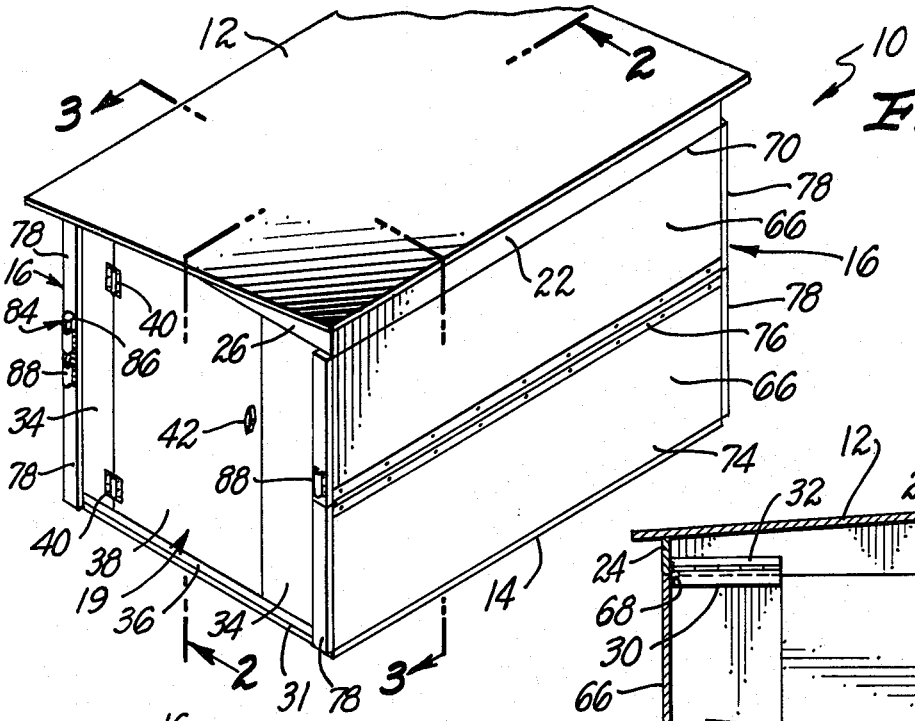
FIG. 1 is an isometric view of a presently preferred embodiment of a collapsible structure in accordance with this invention in a "normal" or unfolded type configuration.

The collapsible structures illustrated are constructed so as to embody the principles or concepts of the invention set forth in the appended claims. It is considered that it will be obvious to anyone skilled in the art or field of mechanical linkages that these concepts or principles can be easily utilized in the construction of a wide variety of differently appearing collapsible structures intended for a large variety of different utilizations through the use or exercise of routine engineering skill.

DETAILED DESCRIPTION

In the drawings there is shown a collapsible structure 10 which is primarily intended for utilization as a child's playhouse but which is also considered to have utility as a small storage shed or similar structure. This complete structure 10 in its "normal" or unfolded configuration is a hollow, generally rectilinear structure having a top 12, a bottom 14, parallel, spaced, opposed sides 16 which extend between the top 12 and the bottom 14 and parallel, spaced, opposed ends 18 and 19 extending between the top 12 and the bottom 14.

The particular structure 10 illustrated includes a part of the top 12, a frame 20 having sides 22 and 24 in alignment with the sides 16 and generally trapezoid shaped ends 26 connecting these sides 22 and 24. This frame 20 supports a roof 28 forming a part of the top 12 in such a manner that the roof 28 extends at an angle to the bottom 14 and overhangs the sides 16 and the ends 18 in the conventional manner of any other roof.

Figure 2:
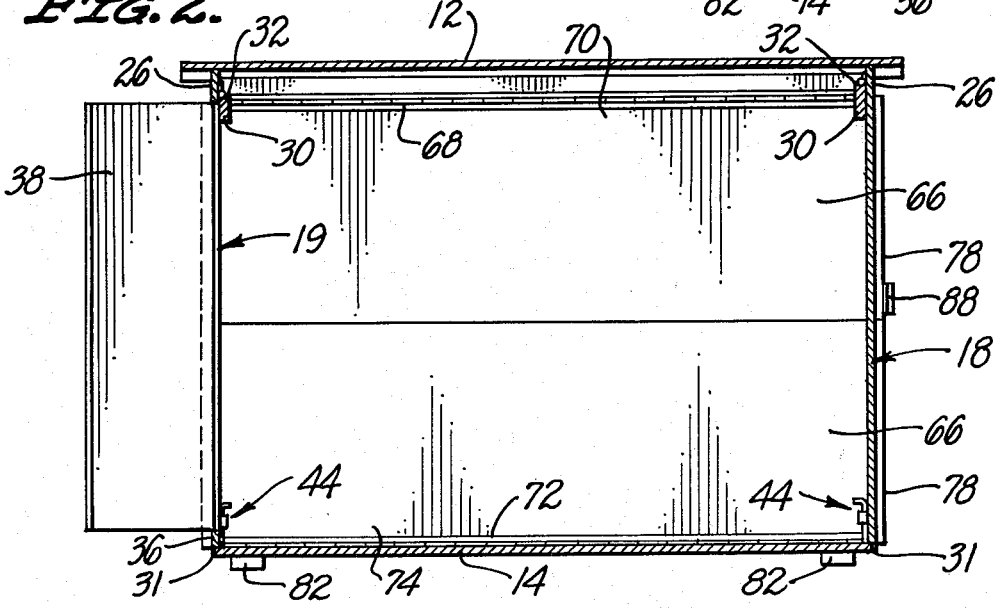
FIG. 2 is a cross-sectional view taken at line 2—2 of FIG. 1 with the door shown in FIG. 1 in an open position.
Figure 6:
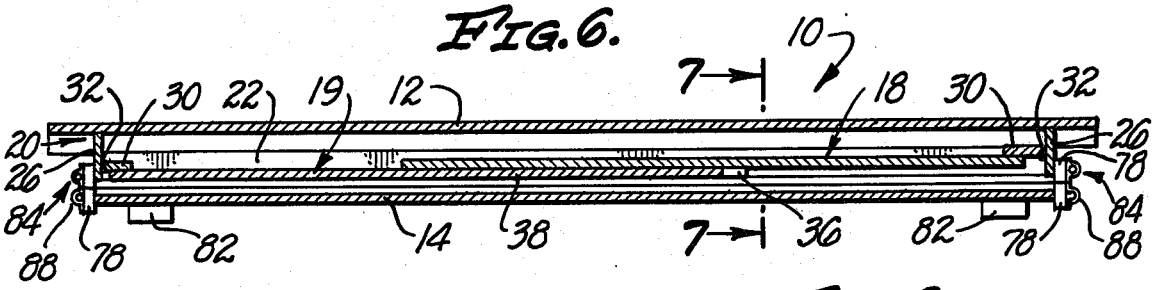
FIG. 6 is a cross-sectional view taken at line 6—6 of FIG. 5.

The end 18 in the structure 10 is a solid panel containing adjacent to the frame 20 a small offset 30 enabling this end 18 to be attached by a hinge 32 to an end 26 of the frame 20 in such a manner that it can be pivoted from a position as shown in FIG. 2 to a position as shown in FIG. 6. The use of the offset 30 in connection with the end 18 is considered advisable in order to provide a junction between an end 26 and the end 18 which is effectively weather resistant. The offset 30 also serves to limit rotation of the end 18 as the structure 10 is manipulated from its folded to its unfolded configuration. This end 18 fits closely between the sides 16 and has a bottom edge 31 which fits closely against the bottom 14.

The other end 19 fits relative to the sides 16 and the bottom 14 in a similar manner. It differs from the end 18 by including two sections 34 each of which corresponds to the end 18 but is of smaller width than the end 18. These sections 34 are provided with offsets 30 as previously described and are connected together by a bottom reinforcing bar 36 extending along its edge 31 and serving as a doorsill. A door 38 is mounted on one of the sections 34 by hinges 40 so as to be capable of being opened either inwardly or outwardly. A conventional door latch set 42 is used in connection with the door 38 and the other of the sections 34 to normally secure the door 38 closed.

Figure 4:
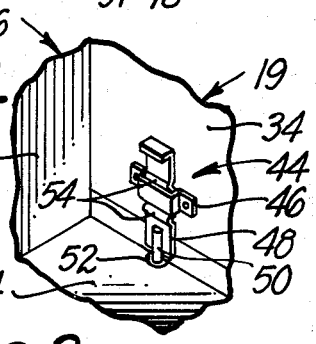
FIG. 4 is an isometric view at an enlarged scale showing a corner junction within the interior of the structure shown in the preceding figures when this construction is in an unfolded configuration.

Latches 44 are preferably utilized in connection with each of the sections 34 and the end 18 in order to prevent the ends 18 and 19 from being pushed inwardly when the structure 10 is in its normal configuration. These latches 44 may be of virtually any desired construction. In FIG. 4 a suitable latch 44 is illustrated as consisting of a U-shaped bracket 46 mounted upon the end 18 in a conventional manner. The bracket 46 holds a resilient strap 48 carrying a projecting pin 50 which is adapted to be inserted into a correspondingly shaped socket 52 in the bottom 14. The strap 48 is provided with resilient ridges 54 which are adapted to engage the bracket 46 in order to hold the strap 48 against undesired movement between a position as shown in FIG. 4 in which the pin 50 is within the socket 52 and a withdrawn position (not shown) in which the pin 50 is generally alongside of the end 18.

Figure 5:
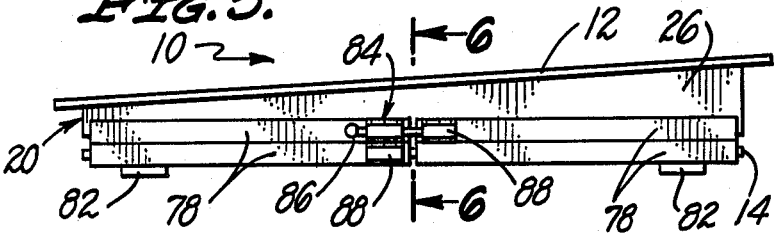
FIG. 5 is an end-elevational view of the structure shown in the preceding figures in a collapsed or folded configuration.

Other latches 56 are preferably provided on the sides 22 and 24 for the purpose of holding the ends 18 and 19 generally within the frame 20 in a substantially or nearly horizontal position when the structure 10 is in a folded or collapsed configuration as indicated in FIGS. 5 and 6. These latches 56 may also be of virtually any desired construction. The latches 56 illustrated are flat, resilient straps having ends 58 which are adapted to be mounted in conventional manners upon the sides 22 and 24. The ends 58 are attached to ramp-like sections 60 which in turn are secured to offset or bent over ends 62. These ends 62 extend outwardly of the frame 20 a short distance through holes 64 in the sides 22 and 24.

Figure 3:
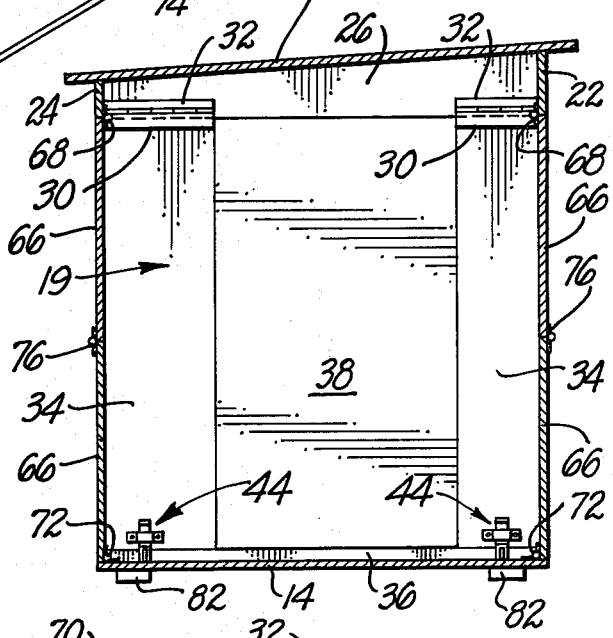
FIG. 3 is a cross-sectional view taken at line 3—3 of FIG. 1.
Figure 7:
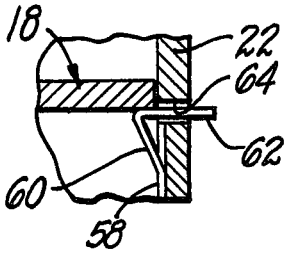
FIG. 7 is a partial cross-sectional view at an enlarged scale taken at line 7—7 of FIG. 6.

The sections 60 are designed so as to "accommodate" the ends 18 and 19 as they are pivoted from their normal positions as shown in FIGS. 1 to 3 of the drawing to folded positions as indicated in FIGS. 6 and 7. Such accommodation results from the sections 60 being engaged by the ends 18 and 19 so as to be flexed to allow the ends 18 and 19 to pass to a point where the resiliency of the latches 56 will return them to their initial position. In the folded positions of the ends 18 and 19 the latches 56 support these ends 18 and 19 so as to secure against movement generally between and within the frame 20.

The sides 16 in the structure 10 include identically dimensioned panels 66 located in edge to edge relationships. First hinges 68 are utilized to connect the tops 70 of the uppermost of the panels 66 to the sides 22 of the frame 20. Further hinges 72 are utilized to connect the bottoms 74 of the lowermost of the panels 66 to the bottom 14. Intermediate hinges 76 are utilized to connect the adjacent edges (not separately numbered) of the panels 66 in each of the sides 16 to one another. These hinges 68, 72 and 76 are oriented with respect to one another so as to all have parallel axes (not separately numbered) so as to permit the panels 66 to be folded from positions as shown in FIGS. 1 to 3 to positions as shown in FIGS. 5 and 6 in which the uppermost of the panels 66 are in the same plane and in which the lowermost panels 66 are in another common plane.

The panels 66 are of the same length as the bottom 14. They are provided at their ends (not separately numbered) with flange-like lips 78 which abut against one another in the unfolded configuration of the structure 10 and which overlie the portions (not separately numbered) of the ends 18 and 19 adjacent to the sides 16 when the structure 10 is in its unfolded configuration. These lips 78 are considered desirable in sealing against weather conditions. When the structure 10 is in its collapsed or folded configuration the lips 78 extend from the panels 66 so as to fit over the extremities 80 of the bottom 14 and so as to fit over the ends 26 of the frame 20. In order to prevent the lips 78 from abutting a supporting surface such as the ground (not shown) small legs 82 are preferably provided on the bottom 14.

In the preferred construction of the structure 10 in the normal or unforded configuration the ends 18 and 19 will fit closely enough adjacent to the sides 16 so as to prevent folding of the panels 66 of the sides 16 and so as to reinforce the sides 16 against relative movement with respect to the top 12 and the bottom 14, even when the latches 44 are not used. The use of the latches 44 obviously adds to the rigidity of the structure 10 when it is in a normal configuration as shown. In order to achieve effective reinforcement against bending the ends 18 and 19 should be sufficiently long so as to fit closely against the bottom 14.

One of the problems which can be encountered with the collapsible structure 10 concerns the stability of the entire structure as it is being erected by being located so that the legs 82 rest on an appropriate supporting surface (not shown) while the top 12 is merely lifted up. During such erection the top 12 is moved parallel to the bottom 14. As this occurs the sides 16 will unfold. If the latches 56 were omitted the ends 18 and 19 would pivot as a result of gravity so as to reinforce the sides 16 when the top 12 was moved to a position directly above and parallel to the bottom 14. The use of the latches 56 prevents such automatic movement of the ends 18 and 19 to an unfolded position. The use of these latches 56 makes it possible to release the ends 18 and 19 when the top 12 is in exactly a desired position in which there is no reasonable chance of the ends 18 and 19 hitting against the uppermost of the panels 66 as they drop to a normal position. The use of the latches 56 for this purpose is an alternative supplement to the use of latch bolts 84.

Stabilization of the structure 10 prior to the ends 18 and 19 being in place can be accomplished through the use of latch bolts 84 mounted upon the lips 78 secured to the uppermost panels 66 of the sides 16 adjacent to the ends 18 and 19. These latch bolts 84 are mounted in place through the use of conventional sliding latch hardware 86 in positions in which they move downwardly so as to engage retainers 88 mounted in a conventional manner on the adjacent lips 78 of the lowermost of the panels 66 when the sides 16 are unfolded to a flat configuration. This will hold the panels 66 in a proper position so that the latches 56 may be actuated by pulling on the ends 62 so as to release the ends 18 and 19 so that they will pivot them in place with a minimum of difficulty. The latches 44 may be then used to secure the ends 18 and 19.

Although it is possible to utilize two of the latch bolts 84 at each end of the structure 10 it is preferred to utilize only a single one of these latch bolts 84 at an end of the complete structure 10 and to utilize two of the retainers 88 in connection with each such latch bolt 84. With this construction one of the retainers 88 is mounted as previously described while the other retainer 88 is mounted on a lip 78 of the uppermost of the panels 66 on the side 16 opposite the side 16 on which the latch bolt 84 is used. With this construction the latch bolt 84 can be actuated so as to extend between two of the panels 66 on opposite sides 16 in order to secure the structure 10 against inadvertent or undesired manipulation from a collapsed or folded configuration.

In order to achieve the type of action described in the preceding it is necessary that the sides 16 be of such a height that their height is greater than the distance between the sides 16. This distance closely approximates the width of the ends 18 and 19 and is just slightly larger than the widths of these ends. Further, it is necessary that the lengths of the sides 16 be greater than this height so that the ends 18 and 19 may be pivoted so as to be folded generally within the frame 20 generally alongside of the top 12.

Figure 8:
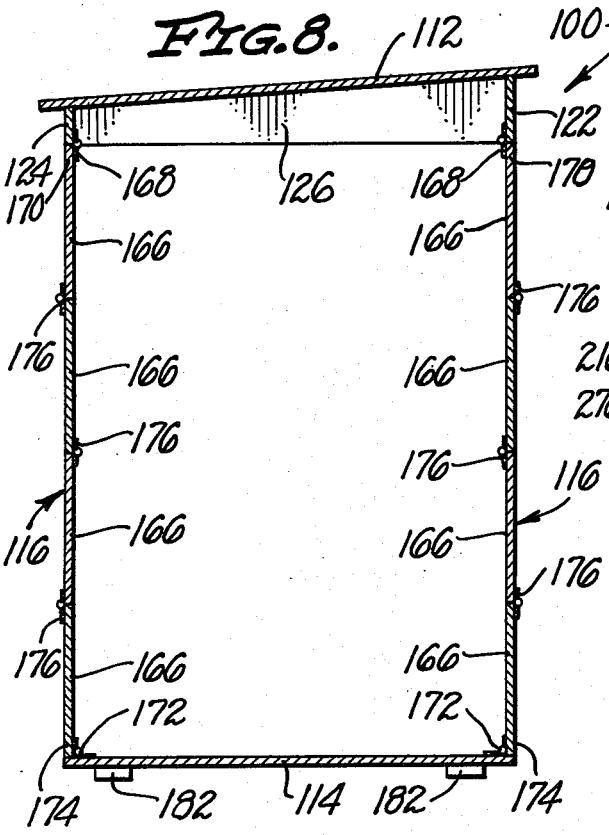
FIG. 8 is a view corresponding to FIG. 3 of a modified collapsible structure in accordance with the invention which is closely related to the collapsible structure illustrated in the preceding figures.

If it is desired to form the structure 10 so that this structure is taller than the use of the panels 66 in each of the sides 16 permits, it is possible to modify the structure 10 in the manner indicated in FIG. 8. Here there is shown a modified structure 100 which is identical to the structure 10 except as herein indicated. Because of the similarity between the structures 10 and 100 various parts of the structure 100 are not separately described herein except as necessary for explanatory purposes and are indicated in the drawing and in the remainder of this specification by the numbers previously utilized to describe such parts preceded by the numeral "1".

In the structure 100 the sides 116 differ from the previously described sides 16 by each utilizing four panels 166 joined by intermediate hinges 176 in such a manner as to permit these panels 166 to be folded in an accordian like manner generally between the top 112 and the bottom 114. Any even number of panels 166 may be utilized in a side 116.

Figure 9:
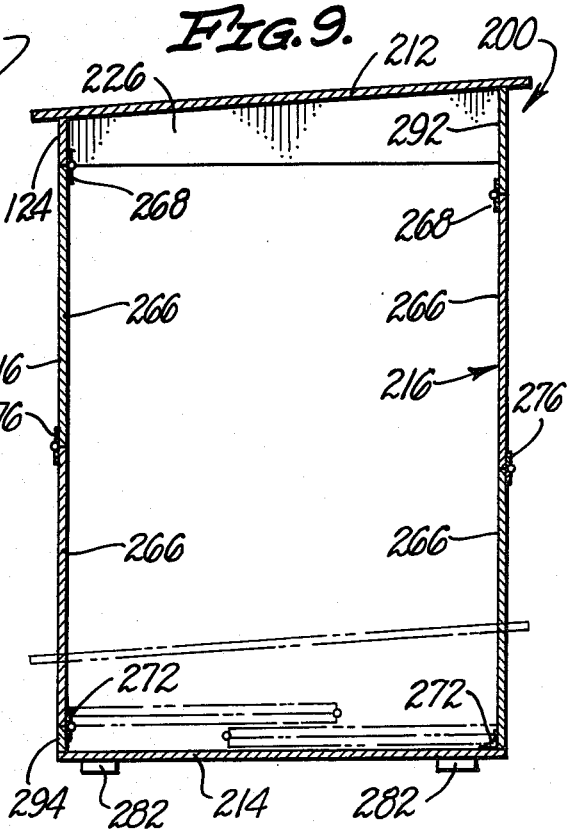
FIG. 9 is a view corresponding to FIG. 3 of a further modified collapsible structure in accordance with the invention which is also closely related to the collapsible structure illustrated in the preceding figures.

In FIG. 9 of the drawing there is shown a further modified structure 200 which is also substantially identical to the structure 10 except as herein indicated. Because of the similarity between the structures 10 and 200 various parts of the structure 200 which are the same or substantially the same as corresponding parts of the structure 10 are not separately described herein except as necessary for explanatory purposes and are indicated in the drawing and in the remainder of this specification by the numerals previously utilized to describe such parts preceded by the numeral "2".

The structure 200 differs from the previously described structures 10 and 100 by utilizing sides 216 which consist of pairs of panels 266 corresponding to the panels 66 described in the preceding in connection with the structure 10. In the case of the structure 200 an extension 292 on the side 222 of the frame 220 is attached to the uppermost of one of the panels 266 of a side 216 by hinges 268. A corresponding extension 294 on the bottom 214 is connected by hinges 272 to the lowermost of the panels 266. In effect this extension 294 serves as a part of the side 216 to which it is attached.

The use of the panels 266 in the structure 200 enables the panels 266 to be folded as indicated by phantom lines in FIG. 9 so as to at least partially lie alongside one another when the structure 200 is in a folded configuration. While this is desirable in structures in which it is desired to maximize the height of the structure while minimizing the width of the structure with as few parts as reasonably possible, it is also considered to be somewhat disadvantageous because the structure 200 will not fold as compactly as the other structures 10 and 100 described.

Obviously a structure such as the structures 10, 100 or 200 can be modified in a variety of different ways. As an example of this it is possible to include in any of the panels 66 openings 90 which are adapted to serve as windows and/or to facilitate play activities. Such openings 90 may be provided with appropriate door-like closures (not shown) when a structure 10 is primarily intended for storage uses as well as for occasional playhouse usage. Because various modifications of this type are essentially of an obvious type as may be required for any particular application or use of the structure 10 it is not considered necessary to enumerate all of such modifications in this specification.

We claim:

1. In a hollow, generally rectilinear structure having a top, a bottom, parallel, spaced, opposed sides extending between said top and said bottom and parallel, spaced, opposed ends extending between said top and bottom the improvement which comprises:

frame means for use in providing space into which both of said ends fit when said structure is in a folded configuration, said frame means forming a part of said top, being located generally beneath the remainder of said top and serving to space said sides from the remainder of said top, a first hinge means connecting each of said ends with said top holding the one of said ends to which it is connected so that such end can be pivoted to a position generally parallel to said top and within said frame means, each of said sides consisting of an even number of panels having parallel top and bottom edges, said panels in each of said sides being located in edge to edge relationship with the lowermost of said panels being located with a bottom edge against said bottom and with the uppermost of said panels being located with a top edge against said frame means, another hinge means connecting the top of the uppermost of said panels of each of said sides with said frame means, a further hinge means connecting the bottom of each of said panels of each of said sides with said bottom, intermediate hinge means on each of said sides connecting the adjacent side edges of said panels together, said other, said further and said intermediate hinge means being oriented so as to permit both of said sides to be folded generally between said bottom and said frame means when said ends are positioned generally within said frame means, said ends fitting closely with respect to the interiors of said sides so as to abut against said sides to prevent folding of said panels of said sides and serving to reinforce said sides against movement relative to said top and said bottom, each of said sides consists of two of said panels, a lip means at the end of each of said panels, said lip means extending from said panels so as to cover the edges of said ends adjacent to said sides, said lip means on the uppermost of said panels of said sides overlap the extremities of said ends which are attached to said first hinge means when both said ends and said sides are in said folded position, said lip means on the lowermost of said panels of said sides overlap the extremities of said bottom when both said sides and said bottom are in said folded configuration.

2. A structure as claimed in claim 1 including:

other latch means mounted on said lip means for holding said panels of each of said sides in alignment with one another prior to said end fitting between said sides when said panels of said sides are in alignment with one another and for holding said panels against unfolding when said sides are folded generally between said bottom and said frame means.

3. In a hollow, generally rectilinear structure having an imperforate top, a bottom, parallel, spaced, opposed sides extending between said top and said bottom and parallel, spaced opposed ends extending between said top and bottom the improvement which comprises:

frame means for use in providing space into which both of said ends fit when said structure is in a folded configuration, said frame means forming a part of said top, being located generally beneath the remainder of said top and serving to space said sides from the remainder of said top, a first hinge means connecting each of said ends with said top holding the one of said ends to which it is connected so that such end can be pivoted to a position generally parallel to said top and within said frame means, each of said sides consisting of an even number of panels having parallel top and bottom edges, said panels in each of said sides being located in edge to edge relationship with the lowermost of said panels being located with a bottom edge against said bottom and with the uppermost of said panels being located with a top edge against said frame means, another hinge means connecting the top of the uppermost of said panels of each of said sides with said frame means, a further hinge means connecting the bottom of each of said panels of each of said sides with said bottom, intermediate hinge means on each of said sides connecting the adjacent side edges of said panels together, said other, said further and said intermediate hinge means being oriented so as to permit both of said sides to be folded generally between said bottom and said frame means when said ends are positioned generally within said frame means, said ends fitting closely with respect to the interiors of said sides so as to abut against said sides to prevent folding of said panels of said sides and serving to reinforce said sides against movement relative to said top and said bottom, further latch means for holding each of said ends generally within said frame means, said further latch means are accessible from the exterior of said structure beneath said top.

4. A structure as claimed in claim 3 wherein:

latch means is provided for holding said ends and said bottom in fixed relation with respect to one another, said latch means is inaccessible from the exterior of said structure, each of said sides consists of two of said panels, one of said ends consists of two panels and a door located between said panels, each of said panels being connected to said first hinge means, and including latch means for holding said ends and said bottom with respect to one another, a lip means at the end of each of said panels, said lip means extending from said panels so as to cover the edges of said ends adjacent to said sides, other latch means for holding said panels of each of said sides in alignment with one another.

5. In a hollow, generally rectilinear structure having a top, a bottom, parallel, spaced opposed sides extending between said top and said bottom and parallel, spaced, opposed ends extending between said top and bottom the improvement which comprises:

frame means for use in providing space into which both of said ends fit when said structure is in a folded configuration, said frame means forming a part of said top, being located generally beneath the remainder of said top and serving to space said sides from the remainder of said top, a first hinge means connecting each of said ends with said top holding the one of said ends to which it is connected so that such end can be pivoted to a position generally parallel to said top and within said frame means, each of said sides consisting of an even number of panels having parallel top and bottom edges, said panels in each of said sides being located in edge to edge relationship with the lowermost of said panels being located with a bottom edge against said bottom and with the uppermost of said panels being located with a top edge against said frame means, another hinge means connecting the top of the uppermost of said panels of each of said sides with said frame means, a further hinge means connecting the bottom of each of said panels of each of said sides with said bottom, intermediate hinge means on each of said sides connecting the adjacent side edges of said panels together, said other, said further and said intermediate hinge means being oriented so as to permit both of said sides to be folded generally between said bottom and said frame means when said ends are positioned generally within said frame means, said ends fitting closely with respect to the interiors of said sides so as to abut against said sides to prevent folding of said panels of said sides and serving to reinforce said sides against movement relative to said top and said bottom, each of said sides consists of two of said panels, other latch means for holding said panels of each of said sides in alignment with one another prior to said ends fitting within said sides, said other latch means including parts, one of which parts is attached to one of said panels of one of said sides, the other of which parts is attached to one of said panels of the other of said side, said other latch means being capable of being manipulated so as to extend between said panels to which said parts are attached so as to hold said panels of each of said sides in alignment.

6. A structure as claimed in claim 5 including:

a lip means at the end of each of said panels, said lip means extending from said panels so as to cover the edges of said ends adjacent to said sides, and wherein said other latch means are mounted on said lip means so as to connect the lip means on the panels of each of said sides when said panels are in alignment with one another.

7. A structure as claimed in claim 5 wherein:

said other latch means is capable of holding said panels against unfolding when said sides are folded generally between said bottom and said frame means.

* * * * *